United States Patent [19]

Fast

[11] Patent Number: 4,694,596

[45] Date of Patent: Sep. 22, 1987

[54] MERCHANDISE INFORMATION TAG WITH IMPROVED MOUNTING PORTION

[76] Inventor: Jacob Fast, 7561 NW. 9th St., Plantation, Fla. 33317

[21] Appl. No.: 726,357

[22] Filed: Apr. 23, 1985

Related U.S. Application Data

[63] Continuation-in-part of Ser. No. 422,010, Sep. 23, 1982, Pat. No. 4,539,766, which is a continuation-in-part of Ser. No. 358,925, Mar. 17, 1982.

[51] Int. Cl.[4] ..... G09F 3/08

[52] U.S. Cl. ..... 40/20 R; 40/628; 40/622; 40/489

[58] Field of Search ..... 40/2, 10, 20, 22, 618, 40/622

[56] References Cited

U.S. PATENT DOCUMENTS

| | | | |
|---|---|---|---|
| 333,303 | 12/1895 | Howard | 40/622 |
| 2,814,894 | 12/1957 | Horton | 40/622 |
| 3,089,269 | 5/1963 | McKiernan | 40/622 |
| 3,358,395 | 12/1967 | Simonovic | 40/489 |

FOREIGN PATENT DOCUMENTS

| | | | |
|---|---|---|---|
| 113568 | 7/1941 | Australia | 40/22 |
| 999376 | 1/1952 | France | 40/22 |

*Primary Examiner*—Gene Mancene
*Assistant Examiner*—Wenceslao J. Contreras
*Attorney, Agent, or Firm*—Holman & Stern

[57] ABSTRACT

A merchandise information tag for mounting face-to-face against a surface of a perforated board has projections for fitting in respective holes of the perforated board to retain the tag on the board. The projections are slit longitudinally into fingers which are squeezed together in the respective holes so that the projections are held in the holes by friction.

3 Claims, 7 Drawing Figures

MERCHANDISE INFORMATION TAG WITH IMPROVED MOUNTING PORTION

CROSS REFERENCE TO RELATED APPLICATIONS

This application is a continuation-in-part of application Ser. No. 422,010, filed Sept. 23, 1982 for "Improved Merchandise Information Tag", now U.S. Pat. No. 4,539,766, which is itself a continuation-in-part of application Ser. No. 358,925, filed Mar. 17, 1982 for "Merchandise Information Tag". The subject matter of both of the prior applications is expressly incorporated herein by reference.

BACKGROUND OF THE INVENTION

This invention relates to merchandise information tags to be associated with merchandise displays in stores, supermarkets and the like, for indicating merchandise data such as identification codes, prices and the like.

Point of sale merchandising displays often use elongate display hooks, for example, which project from perforated boards and the like for suspending rows of products thereon. Blister packs, for example, are commonly suspended from such hooks.

Where it is desirable to display product information in conjunction with a hook of the above type, this may, for example, be displayed by way of an information tag (which may carry an information label or the like) the tag being of a type which is secured directly on the perforated board behind the products, or alternatively of a type which projects forward of the products on the hook. The present invention is concerned with information tags of the former type.

SUMMARY OF THE INVENTION

The parent application discloses, with particular reference to FIGS. 7 to 10, a merchandise information tag for face-to-face mounting on a perforated board, the tag comprising a rectangular piece of plastic sheet material with projections on its opposite sides terminating in arrow-like heads, the projections being folded back and inserted through holes of the perforated board by folding the arrow heads, and the arrow heads when inserted right through the board reverting to their normal shape so as to positively lock the tag face-to-face against the board. To remove the tag, it is necessary to fold the arrow heads and pull the projections back through the holes in the board.

It is an object of the present invention to provide a merchandise information tag which is generally of the type described in connection with FIGS. 7 to 10 of the parent application, which will effectively engage in holes in the perforated board and remain in face-to-face engagement against the board, but which is somewhat easier to remove from the board than the tags described above, and which will not be as subject to tearing of the projections which hold the tags to the board as the previous tags, if a tag is forcibly removed from the board.

With the above object in view, the invention provides a merchandise information tag structure of sheet material, such as plastic sheet, with projections on opposite sides of the tag for folding back and inserting in holes of a perforated board structure or the like, wherein each projection is slit longitudinally into a pair of fingers, the overall width of which is related to the diameter of the perforated board holes so that the fingers are squeezed together when inserted into a hole for retention therein by friction created by the tendency of the fingers resiliently to revert to their normal unstressed state. To faciliate insertion, the fingers may be tapered toward their free ends.

It is found that the frictional retention of the projections in the perforated board holes as aforesaid effectively retains the tag in face-to-face engagement on the board, while the absence of headed members on the projections which positively engage behind the board (as in the tags disclosed in the parent application) facilitates removal of the tag when required without the tendency to tear the projections in the case of a forcible removal. As in the parent application, tags in accordance with the invention may be scored in batches in a large sheet of plastic for selective individual removal from the sheet.

Additional features of the invention will be clear from the following description and claims read in conjunction with the attached drawings.

DESCRIPTION OF PREFERRED EMBODIMENTS

A merchandise tag in accordance with the invention may, for example, be die-cut from stiff plastic sheet material and may comprise a body portion 10, for example for receipt of an adhesive label, and a pair of projections 12 extending respectively from opposite side edges 10*a*, 10*b* of the body portion. The tag is particularly intended for use in face-to-face engagement on the outer surface of a perforated board 14 or the like, for example for displaying merchandise information regarding products which may be suspended from elongate hooks mounted on the board. To this end, the projections 12 engage in respective holes 16 of the perforated board as will be described.

Figure 1:
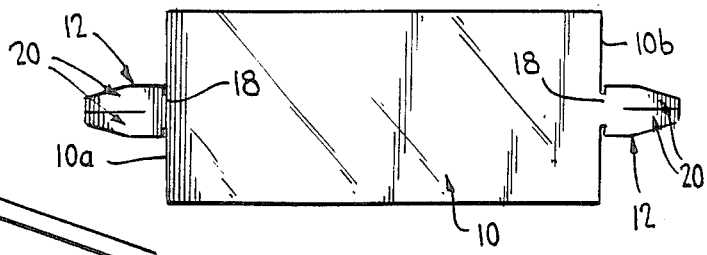
FIG. 1 is an elevational view of a merchandise tag in accordance with the invention.
Figure 2:
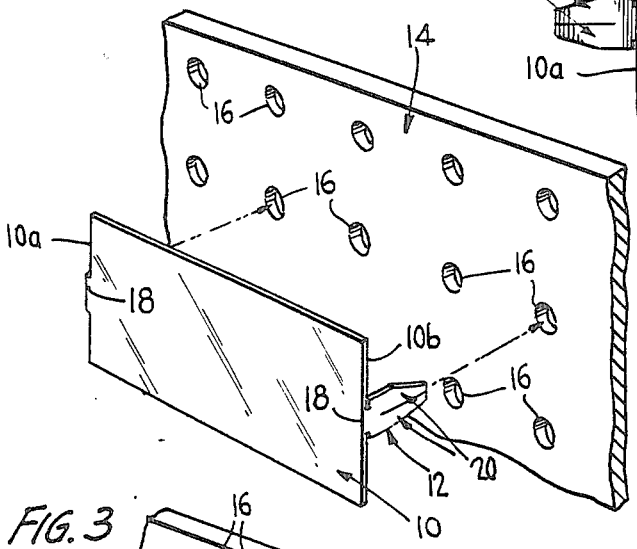
FIG. 2 is an exploded perspective view of the tag and a perforated board in which it is to be attached.
Figure 5:
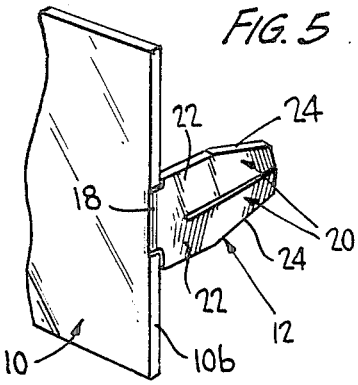
FIG. 5 is an enlarged perspective view of an end portion of the tag.
Figure 3:
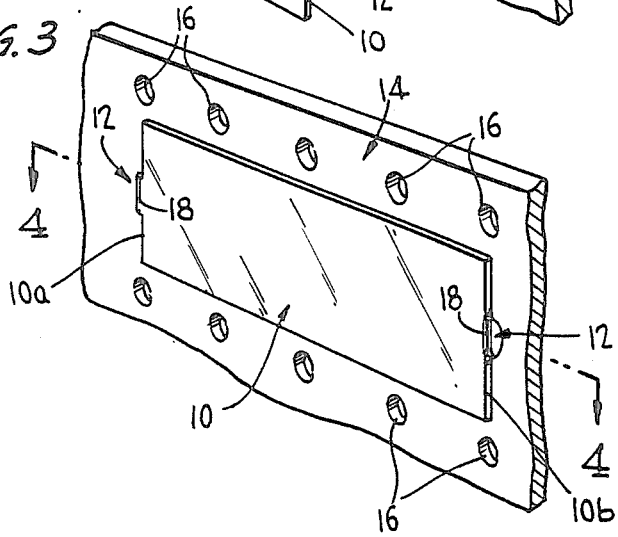
FIG. 3 is a perspective view of the tag attached to the board.
Figure 6:
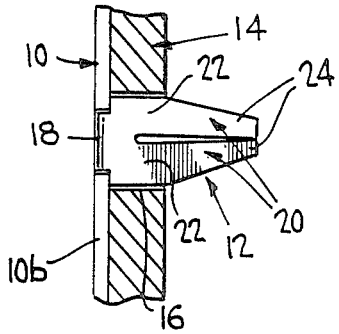
FIG. 6 is a side elevation of part of the tag with the pegboard shown in section.
Figure 4:
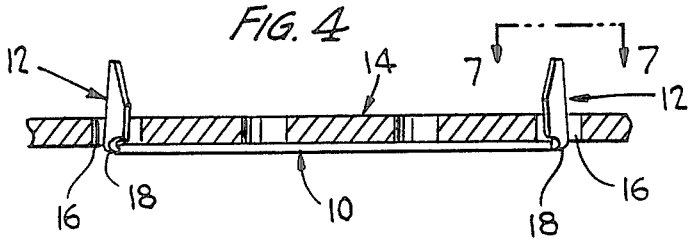
FIG. 4 is a sectional view on line 4—4 of FIG. 3.
Figure 7:
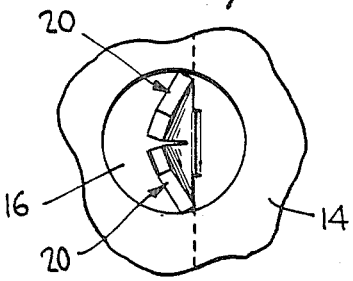
FIG. 7 is an enlarged view on line 7—7 of FIG. 4.

It will be seen that each of the projections 12 is joined to the respective side 10*a*, 10*b* of the tag by foldable neck portions 18 and that the projections are slit longitudinally to form fingers 20. Further, the fingers have base portions 22 which are the full width of the respective projection, and outer tapering portions 24 (see FIGS. 5 and 6). The full width of the projection is made somewhat in excess of the diameter of holes 16 and the length of portions 22 is about equal to the thickness of board 14. The distance between the projections is equal to the center distance between selected holes 16 in the perforated board. Thus, when the projections are folded back (FIGS. 2 and 5) and pressed into the holes, the tapered form of the fingers facilitating insertion, the fingers will be squeezed together and when pressed fully home so that the tag body 10 is face-to-face with the front surface of the board, the projections will be retained in the holes by friction created by the tendency of the fingers to spread resiliently to their normal shape, sufficient to maintain the tag in face-to-face relation with the board in normal use. However, since the projections have no theaded portions behind the board, the tag can be readily removed by simply pulling the projections out of the holes, and there is substantially no tendency for the projections to tear even if the tag is forcibly removed. Thus, the tag is suitable for multiple reuse.

While only a preferred embodiment of the invention has been described herein in detail, the invention is not limited thereby and modifications are possible within the scope of the attached claims.

I claim:

1. A merchandise information tag comprising a body member of plastic sheet material including a substantially planar sheet material body portion and sheet material projections integral with the body portion extending respectively in the same plane as said body portion from opposite sides of the body portion, neck portions connecting said projections to said body portion so that said projections can be folded substantially at right angles to said body portion for insertion in spaced holes of a perforated board structure or the like for mounting the body portion substantially face-to-face with a surface of the perforated board structure when the projections are extended behind the body portion, wherein each projection has a base portion with parallel sides adjacent the neck portion, and an end portion with tapered converging sides, and wherein each projection is slit longitudinally into a pair of fingers to be squeezed together when inserted in the respective opening for holding the projection in the opening by friction.

2. The invention of claim 1 wherein the body member is rectangular.

3. In combination, a perforated board structure and a merchandise information tag according to claim 1, said perforated board structure including a multiplicity of openings and said projections of said merchandise information tag being folded substantially at right angles to said body portion and inserted into spaced openings in the perforated board with said body portion mounted substantially face-to-face against a surface of the perforated board, each of said projections being retained in its respective opening by friction.

* * * * *